US008125306B2

(12) United States Patent
Tsai et al.

(10) Patent No.: US 8,125,306 B2
(45) Date of Patent: Feb. 28, 2012

(54) TRANSFORMER SET

(75) Inventors: Hsin-Wei Tsai, Taoyuan Hsien (TW); Yi-Lin Chen, Taoyuan Hsien (TW); Chun-Ping Chen, Taoyuan Hsien (TW); Shih-Yun Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/045,242

(22) Filed: Mar. 10, 2011

(65) Prior Publication Data

US 2011/0221559 A1 Sep. 15, 2011

(30) Foreign Application Priority Data

Mar. 12, 2010 (TW) ..... 99107306 A

(51) Int. Cl.
*H01F 27/30* (2006.01)

(52) U.S. Cl. ..... 336/198

(58) Field of Classification Search ..... 336/65, 336/83, 192, 198, 200, 220–223, 170, 173, 336/180–184
See application file for complete search history.

(56) References Cited

U.S. PATENT DOCUMENTS

| | | | | |
|---|---|---|---|---|
| 7,696,851 | B1 * | 4/2010 | Ger et al. | 336/198 |
| 7,714,689 | B1 * | 5/2010 | Hsieh | 336/208 |
| 7,830,234 | B1 * | 11/2010 | Tien et al. | 336/208 |
| 7,864,020 | B2 * | 1/2011 | Chen et al. | 336/208 |
| 2009/0153280 | A1 * | 6/2009 | Chen et al. | 336/192 |

* cited by examiner

*Primary Examiner* — Tuyen Nguyen
(74) *Attorney, Agent, or Firm* — Kirton & McConkie; Evan R. Witt

(57) ABSTRACT

A transformer set includes a first bobbin piece, a second bobbin piece, a third bobbin piece, a fourth bobbin piece and a magnetic core assembly. The second bobbin piece has a first pin and a second pin. A first terminal of a first secondary winding coil is fixed on the first pin, then the first secondary winding coil is successively wound on the second bobbin piece and returned back, and a second terminal of the first secondary winding coil is fixed on the second pin. The fourth bobbin piece has a third pin and a fourth pin. A first terminal of a second secondary winding coil is fixed on the third pin, then the second secondary winding coil is successively wound on the fourth bobbin piece and returned back, and a second terminal of the second secondary winding coil is fixed on the fourth pin.

20 Claims, 5 Drawing Sheets

TRANSFORMER SET

FIELD OF THE INVENTION

The present invention relates to a transformer set, and more particularly to a transformer set for avoiding high-voltage spark.

BACKGROUND OF THE INVENTION

A transformer has become an essential electronic component for voltage regulation into required voltages for various kinds of electric appliances.

FIG. 1 is a schematic exploded view illustrating a conventional transformer. As shown in FIG. 1, the transformer 1 comprises a magnetic core assembly 11, a first bobbin piece 12, a second bobbin piece 13, a primary winding coil 14 and a secondary winding coil 15. The first bobbin piece 11 has a first side plate 16. The second bobbin piece 13 has a second side plate 17 and plural partition plates 13*a*. Several winding sections 13*b* are defined by every two adjacent partition plates 13*a*. According to a voltage-dividing principle, the number of winding sections 13*b* may be varied depending on the voltage magnitude. In addition, a first base 16*a* and a second base 17*a* are extended from the first side plate 16 and the second side plate 17, respectively. Several pins 18 and 19 are respectively arranged on the bottom surfaces of the first base 16*a* and the second base 17*a*.

For winding the primary winding coil 14 on the first bobbin piece 11, a first terminal of the primary winding coil 14 is firstly wound around and fixed on a pin 18*a* under the first base 16*a*. The primary winding coil 14 is then successively wound on the first bobbin piece 11 in the direction distant from the first side plate 16. Then, the primary winding coil 14 is returned back, and a second terminal of the primary winding coil 14 is wound around and fixed on another pin 18*b* under the first base 16*a*. For winding the secondary winding coil 15 on the second bobbin piece 13, a first terminal of the secondary winding coil 15 is firstly wound around and fixed on a pin 19*a* under the second base 17*a*. The secondary winding coil 15 is then successively wound on the winding sections 13*b* of the second bobbin piece 13 in the direction distant from the second side plate 17. Then, the secondary winding coil 15 is returned back, and a second terminal of the secondary winding coil 15 is returned to be wound around and fixed on another pin 19*b* under the second base 17*a*. Moreover, due to the partition plate 13*a* of the second bobbin piece 13, the primary winding coil 14 is separated from the secondary winding coil 15, thereby maintaining an electrical safety distance and increasing leakage inductance of the transformer 1.

The winding structure of the transformer 1, however, still has some drawbacks. For example, since the primary winding coil 14 and the secondary winding coil 15 are returned back to be respectively fixed on the pins 18*b* and 19*b* under the first base 16*a* and the second base 17*a*, portions of the primary winding coil 14 and the secondary winding coil 15 are exposed under the first bobbin piece 11 and the second bobbin piece 13. Even if the exposed portions are covered by insulating material, the safety distance is also insufficient. Under this circumstance, the transformer 1 is readily suffered from high-voltage spark or short circuit and eventually has a breakdown.

For increasing the working voltage, two or more transformers are connected in parallel to collectively define a transformer set. FIG. 2 is an exploded view illustrating a transformer set according to the prior art. As shown in FIG. 2, the transformer set comprises a first transformer 2 and a second transformer 3, which are arranged in parallel with each other. The first transformer 2 comprises a first bobbin piece 22 and a second bobbin piece 23. The second transformer 3 also comprises a first bobbin piece 32 and a second bobbin piece 33. The first bobbin pieces 22 and 32 have the same structures. The second bobbin pieces 23 and 33 have the same structures. Since the first transformer 2 and the second transformer 3 have the same structures, only the first transformer 2 is illustrated for clarification herein.

The first bobbin piece 22 comprises a base 221, a sheathing part 222 and a first channel 223. A winding section 224 is arranged between the base 221 and the sheathing part 222 for winding a primary winding coil 24. The sheathing part 222 is substantially a rectangular hollow structure with a receptacle 222*a*. The first channel 223 runs through the base 221 and the winding section 224. In addition, the first channel 223 is in communication with the receptacle 222*a* of the sheathing part 222. The second bobbin piece 23 and the secondary winding coil 25 that is wound around the second bobbin piece 23 are accommodated within the receptacle 222*a* of the sheathing part 222. As such, by the sheathing part 222, the primary winding coil 24 and the secondary winding coil 25 are separated from each other, and the first channel 223 of the first bobbin piece 22 and the second channel 235 of the second bobbin piece 23 are in communication with each other. The second bobbin piece 23 comprises a first side plate 230, a second side plate 238, plural partition plates 232, a slab 233 and a base 231. The first side plate 230, the second side plate 238, the partition plates 232 and the base 231 have rectangular profiles. The first side plate 230 and the second side plate 238 are arranged on two opposite sides of the second bobbin piece 23. In addition, the first side plate 230 and the second side plate 238 are perforated plates. The partition plates 232 are parallel with the first side plate 230 and the second side plate 238. As such, the partition plates 232, the first side plate 230, the second side plate 238 and the slab 233 collectively define plural winding sections 234 for winding the secondary winding coil 25.

The base 231 is extended from the first side plate 230 and connected with the first side plate 230. In addition, a first pin 236 and a second pin 237 are disposed on the base 231 to be inserted into corresponding holes of a circuit board (not shown). The first pin 236 and the second pin 237 are L-shaped. The first pin 236 comprises a first coupling part 236*a* and a second coupling part 236*b*. The second pin 237 comprises a first coupling part 237*a* and a second coupling part 237*b*. For winding the secondary winding coil 25 on the second bobbin piece 23, a first terminal of the secondary winding coil 25 is firstly wound around and fixed on the first coupling part 236*a* of the first pin 236. The secondary winding coil 25 is then successively wound on the winding sections 234, and then wound on an auxiliary part 239. Then, the secondary winding coil 25 is returned back, and a second terminal of the secondary winding coil 25 is fixed onto the first coupling part 237*a* of the second pin 237.

Please refer to FIG. 2 again. The transformer set further comprises a magnetic core assembly 31. The magnetic core assembly 31 comprises a first magnetic part 311 and a second magnetic part 312. The first magnetic part 311 includes a first lateral leg 311*a* and a second lateral leg 311*b*. The second magnetic part 312 includes a first lateral leg 312*a* and a second lateral leg 312*b*. For connecting the first transformer 2 and the second transformer 3 in parallel, the first lateral leg 311*a* and the second lateral leg 311*b* of the first magnetic part 311 are respectively embedded into the first channel 223 of the transformer 2 and the first channel 323 of the transformer 3, and the first lateral leg 312*a* and the second lateral leg 312*b* of the second magnetic part 312 are respectively embedded into the second channel 235 of the transformer 2 and the second channel 335 of the transformer 3. As such, the transformers 2 and 3 are combined together to produce the transformer set. The transformer set, however, still has some drawbacks. For example, after the both terminals of the secondary winding coil 25 are respectively fixed on the first coupling parts 236*a* and 237*a* of the pins 236 and 237, the L-shaped pins 236 and 237 are readily shifted. In this situation, the terminals of the secondary winding coil 25 are possibly broken. As known, the increase of wire diameter of the secondary winding coil 25 may reduce the possibility of breaking the terminals of the secondary winding coil 25. However, since the wire diameter is increased, the bobbin pieces need to be re-designed and re-produced. The process of re-designing and re-producing the new bobbin pieces is time-consuming and costly. Moreover, since the bobbin pieces 22, 23, 32 and 33 are made of plastic material, the bases 221, 231, 321 and 331 are readily subject to deformation during the fabricating process because the structural strength is usually insufficient.

Moreover, since the auxiliary part 239 fails to facilitate fixing the returning portion of the secondary winding coil 25 at a specified position, the secondary winding coil 25 is readily abraded when the second bobbin piece 23 is accommodated within the sheathing part 222 of the first bobbin piece 22. In a case that the distance between the returning portion of the secondary winding coil 25 and the secondary winding coil 25 wound on the winding section 234 is very short, the transformer 2 is readily suffered from high-voltage spark. Even if the distance between the returning portion of the secondary winding coil 25 and the secondary winding coil 25 wound on the winding section 234 is increased, the returning portion of the secondary winding coil 25 becomes close to the secondary winding coil 35, and thus the possibility of causing high-voltage spark is increased. In this circumstance, the transformers 2 and 3 are readily damaged.

Therefore, there is a need of providing an improved transformer set so as to obviate the drawbacks encountered from the prior art.

SUMMARY OF THE INVENTION

It is an object of the present invention to provide a transformer set for minimizing the possibility of breaking the secondary winding coil.

Another object of the present invention provides a transformer set having enhanced structural strength.

A further object of the present invention provides a transformer set for avoiding high-voltage spark or short circuit so as to prevent damage of respective transformers of the transformer set.

In accordance with an aspect of the present invention, there is provided a transformer set. The transformer set includes a first bobbin piece, a second bobbin piece, a third bobbin piece, a fourth bobbin piece and a magnetic core assembly. The first bobbin piece is used for winding a first primary winding coil. The first bobbin piece has a first sheathing part. The second bobbin piece is partially accommodated within the first sheathing part of the first bobbin piece. The second bobbin piece includes a first base and plural first winding sections. The first base has a first pin and a second pin. A first terminal of the first secondary winding coil is fixed on the first pin, then the first secondary winding coil is successively wound on the first winding sections and returned back, and then a second terminal of the first secondary winding coil is fixed on the second pin. The third bobbin piece is used for winding a second primary winding coil. The third bobbin piece has a second sheathing part. The third bobbin piece and the first bobbin piece are arranged in bilateral symmetry. The fourth bobbin piece is partially accommodated within the second sheathing part of the third bobbin piece. The fourth bobbin piece and the second bobbin piece are arranged in bilateral symmetry. The fourth bobbin piece includes a second base and plural second winding sections. The second base has a third pin and a fourth pin. A first terminal of the second secondary winding coil is fixed on the third pin, then the second secondary winding coil is successively wound on the second winding sections and returned back, and a second terminal of the second secondary winding coil is fixed on the fourth pin, which is opposed to the second pin. The magnetic core assembly is partially embedded into the first bobbin piece, the second bobbin piece, the third bobbin piece and the fourth bobbin piece. The first primary winding coil, the first secondary winding coil, the second primary winding coil and the second secondary winding coil interact with the magnetic core assembly to achieve the purpose of voltage regulation.

In accordance with another aspect of the present invention, there is provided a transformer set. The transformer set includes a first bobbin piece, a second bobbin piece, a third bobbin piece, a fourth bobbin piece and a magnetic core assembly. The first bobbin piece is used for winding a first primary winding coil. The first bobbin piece has a first sheathing part. The second bobbin piece is partially accommodated within the first sheathing part of the first bobbin piece. The second bobbin piece includes a first base, plural first auxiliary ribs and plural first winding sections. The first base has a first pin and a second pin. A first terminal of the first secondary winding coil is fixed on the first pin, then the first secondary winding coil is successively wound on the first winding sections and returned back in the assistance of the first auxiliary ribs, and then a second terminal of the first secondary winding coil is fixed on the second pin. The third bobbin piece is used for winding a second primary winding coil. The third bobbin piece has a second sheathing part. The third bobbin piece and the first bobbin piece are arranged in bilateral symmetry. The fourth bobbin piece is partially accommodated within the second sheathing part of the third bobbin piece. The fourth bobbin piece and the second bobbin piece are arranged in bilateral symmetry. The fourth bobbin piece includes a second base, plural second auxiliary ribs and plural second winding sections. The second base has a third pin and a fourth pin. A first terminal of the second secondary winding coil is fixed on the third pin, then the second secondary winding coil is successively wound on the second winding sections and returned back in the assistance of the second auxiliary ribs, and a second terminal of the second secondary winding coil is fixed on the fourth pin. The magnetic core assembly is partially embedded into the first bobbin piece, the second bobbin piece, the third bobbin piece and the fourth bobbin piece. The first primary winding coil, the first secondary winding coil, the second primary winding coil and the second secondary winding coil interact with the magnetic core assembly to achieve the purpose of voltage regulation.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
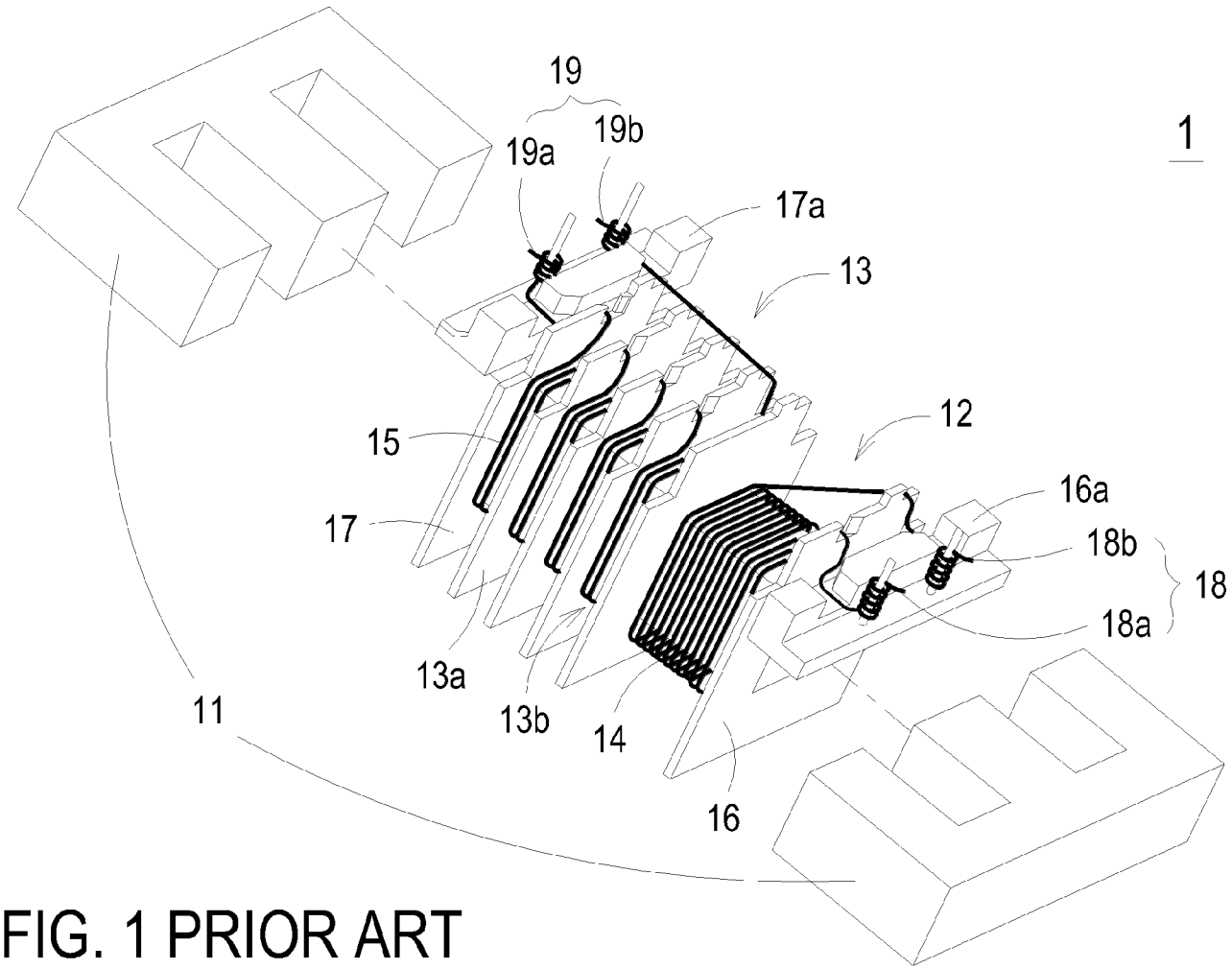
FIG. 1 PRIOR ART
FIG. 1 is a schematic exploded view illustrating a conventional transformer.
Figure 2:
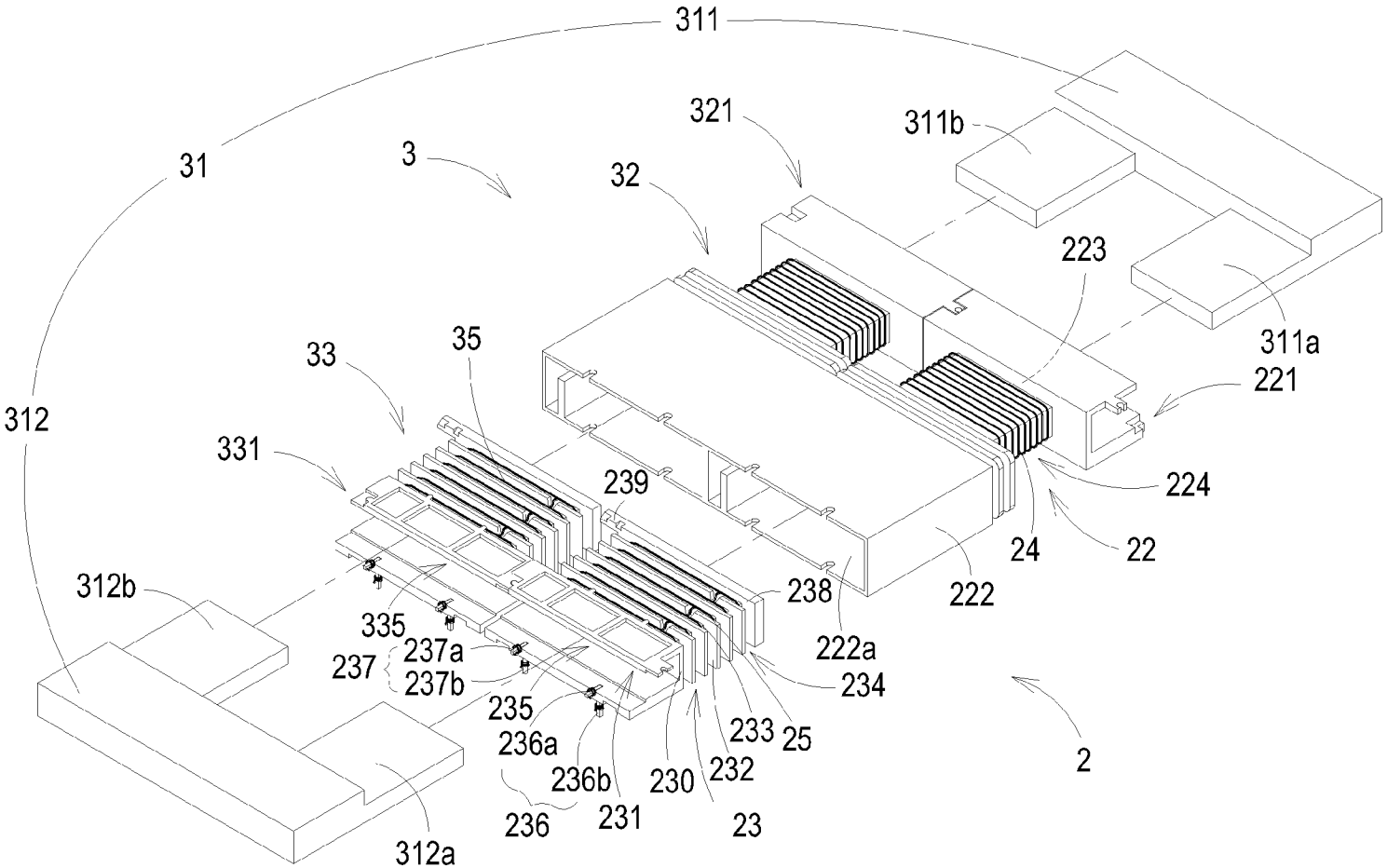
FIG. 2 PRIOR ART
FIG. 2 is an exploded view illustrating a transformer set according to the prior art.
Figure 3:
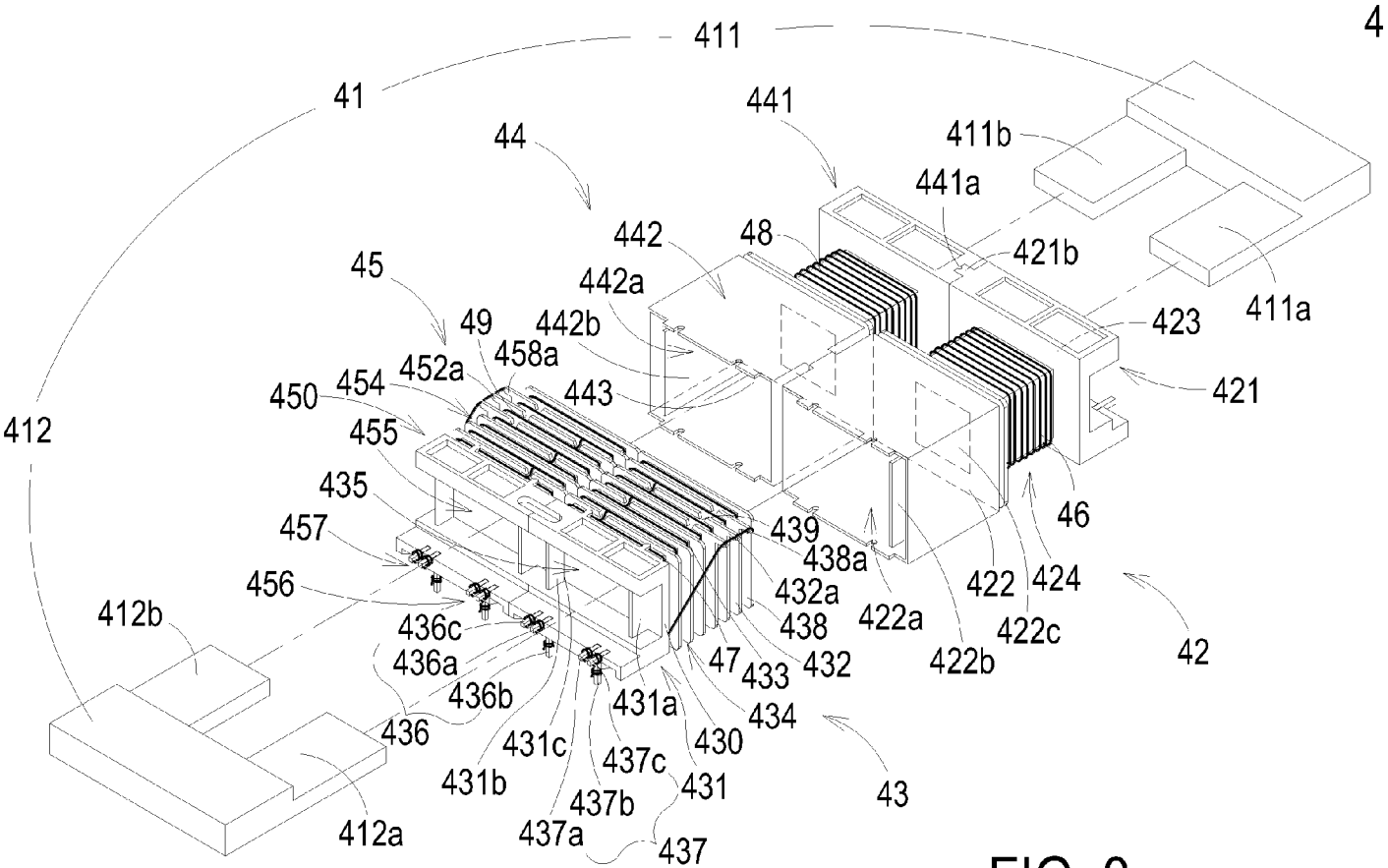
FIG. 3 is an exploded view illustrating a transformer set according to an embodiment of the present invention.

FIG. 3 is an exploded view illustrating a transformer set according to an embodiment of the present invention. As shown in FIG. 3, the transformer set 4 comprises a magnetic core assembly 41, a first bobbin piece 42, a second bobbin piece 43, a third bobbin piece 44, a fourth bobbin piece 45, a first primary winding coil 46, a first secondary winding coil 47, a second primary winding coil 48 and a second secondary winding coil 49.

The magnetic core assembly 41 comprises a first magnetic part 411 and a second magnetic part 412. The first magnetic part 411 includes a first lateral leg 411*a* and a second lateral leg 411*b*. The second magnetic part 412 includes a first lateral leg 412*a* and a second lateral leg 412*b*. The first lateral leg 411*a* of the first magnetic part 411 is embedded within the first bobbin piece 42. The first lateral leg 412*a* of the second magnetic part 412 is embedded within the second bobbin piece 43. The second lateral leg 411*b* of the first magnetic part 411 is embedded within the third bobbin piece 44. The second lateral leg 412*b* of the second magnetic part 412 is embedded within the fourth bobbin piece 45. As such, the first primary winding coil 46, the first secondary winding coil 47, the second primary winding coil 48 and the second secondary winding coil 49 interact with the magnetic core assembly 41 to achieve the purpose of voltage regulation.

In this embodiment, the first bobbin piece 42 comprises a base 421, a first sheathing part 422 and a first channel 423. A winding section 424 is arranged between the base 421 and the sheathing part 422 for winding the first primary winding coil 46. It is preferred that the first sheathing part 422, the winding section 424 and the base 421 of the first bobbin piece 42 are integrally formed. The first sheathing part 422 is substantially a rectangular hollow structure with a receptacle 422*a*. In addition, a third partition plate 422*b* is extended from an inner surface of the first sheathing part 422 and a slot is formed between another inner surface of the first sheathing part 422 and the top edge of the third partition plate 422*b*. The first channel 423 runs through the base 421 and the winding section 424. In addition, the first channel 423 is in communication with the receptacle 422*a* of the first sheathing part 422. The second bobbin piece 43 and the first secondary winding coil 47 that is wound around the second bobbin piece 43 are accommodated within the receptacle 422*a* of the first sheathing part 422. As such, by the first sheathing part 422, the first primary winding coil 46 and the first secondary winding coil 47 are separated from each other, and the first channel 423 of the first bobbin piece 42 and the second channel 435 of the second bobbin piece 43 are in communication with each other.

In some embodiments, the first channel 423 of the first bobbin piece 42 and the second channel 435 of the second bobbin piece 43 are separated from each other by a separation wall (not shown), so that the first channel 423 and the second channel 435 are not in communication with each other. In this circumstance, the first sheathing part 422 has five sidewalls to define a rectangular hollow structure, wherein the first sheathing part 422 is opened to the side opposed to the winding section 424. As such, the second bobbin piece 43 is partially accommodated within the receptacle 422*a* of the first sheathing part 422. The sidewall 422*c* of the first sheathing part 422 that is adjacent to the winding section 424 is served as the separation wall for insulating the second magnetic part 412 from the first primary winding coil 46 and insulating the first magnetic part 411 from the first secondary winding coil 47. Moreover, by changing the thickness of the sidewall 422*c* (i.e. the thickness of the separation wall for separating the first primary side from the first secondary side), the leakage inductance of the transformer set is adjustable. Since the sheathing part and the separation wall can separate the first primary side from the first secondary side, the creepage distance is increased, the distance between the first primary side and the first secondary side is shortened, and the overall length of the transformer set is reduced.

Please refer to FIG. 3 again. The second bobbin piece 43 comprises a first side plate 430, a second side plate 438, a plurality of first partition plates 432, a first slab 433 and a first base 431. The first side plate 430, the second side plate 438, the first partition plates 432, the first slab 433 and the base 431 have rectangular profiles. The first side plate 430 and the second side plate 438 are arranged on two opposite sides of the second bobbin piece 43. In addition, the first side plate 430 and the second side plate 438 are perforated plates. It is preferred that the first side plate 430, the second side plate 438, the first partition plates 432, the first slab 433 and the base 431 are integrally formed.

In some embodiments, the first partition plates 432 are parallel with the first side plate 430 and the second side plate 438. The first slab 433 is arranged between the first side plate 430 and the second side plate 438. In addition, the first slab 433 is connected with the first side plate 430, the second side plate 438 and the first partition plates 432, thereby defining a second channel 435 for partially accommodating the second magnetic part 412. In addition, the first side plate 430, the second side plate 438, the first partition plates 432 and the first slab 433 collectively define plural first winding sections 434 for winding the first secondary winding coil 47.

The first base 431 is extended from the first side plate 430 and connected with the first side plate 430. The first base 431 has an opening 431*c* in communication with the second channel 435. In addition, the first base 431 further comprises a third slab 431*a* and a fourth slab 431*b*. The third slab 431*a* and the fourth slab 431*b* are opposed to each other, and connected with the first side plate 430. In addition, since the third slab 431*a* and the fourth slab 431*b* are perpendicular to the first side plate 430, the structural strength of the bilateral sides of the first base 431 is enhanced, and the possibility of deforming the second bobbin piece 43 during the fabricating process is reduced. Similarly, the base 421 of the first bobbin piece 42 further comprises a third slab (not shown) and a fourth slab (not shown) arranged on two opposite sides of the base 421.

Please refer to FIG. 3 again. A first pin 436 and a second pin 437 are disposed on the first base 431 of the second bobbin piece 43 to be inserted into corresponding holes of a circuit board (not shown). In some embodiments, the first pin 436 and the second pin 437 are L-shaped. The first pin 436 and the second pin 437 are inserted into corresponding holes of the first base 431. The first pin 436 comprises a first coupling part 436*a* and a second coupling part 436*b*. The second pin 437 comprises a first coupling part 437*a* and a second coupling part 437*b*. The second coupling part 436*b* of the first pin 436 and the second coupling part 437*b* of the second pin 437 are protruded downwardly and inserted into corresponding holes of the circuit board. The first coupling parts 436*a*, 437*a* and the second coupling part 436*b*, 437*b* are made of conductive material such as copper or aluminum. The first coupling parts 436*a* and the second coupling part 436*b* of the first pin 436 are integrally formed such that the first pin 436 is L-shaped. Similarly, the first coupling part 437*a* and the second coupling part 437*b* of the second pin 437 are integrally formed such that the second pin 437 is L-shaped. The L-shaped pins 436 and 437 could be easily assembled on the first base 431. Moreover, a first auxiliary pin 436*c* and a second auxiliary pin 437*c* are arranged beside the first pin 436 and the second pin 437, respectively. The first auxiliary pin 436*c* and the second auxiliary pin 437*c* may facilitate winding the terminals of the first secondary winding coil 47 on the first pin 436 and the second pin 437.

Hereinafter, a process of winding the first secondary winding coil 47 on the second bobbin piece 43 will be illustrated with reference to FIG. 3. First of all, a first terminal of the first secondary winding coil 47 is wound around and fixed on the first coupling part 436*a* of the first pin 436. Then, the first secondary winding coil 47 is wound around the first auxiliary pin 436*c*, and successively wound on the first winding sections 434 through the notches 439 of respective first partition plates 432. After the first secondary winding coil 47 is wound on the first winding section 434 that is adjacent to the second side plate 438, the first secondary winding coil 47 is returned back in the assistance of the first auxiliary rib 438*a* of the second side plate 438 and the first auxiliary ribs 432*a* of the first partition plates 432. Then, a second terminal of the first secondary winding coil 47 is wound around the second auxiliary pin 437*c* and fixed on the first coupling part 437*a* of the second pin 437.

Figure 4:
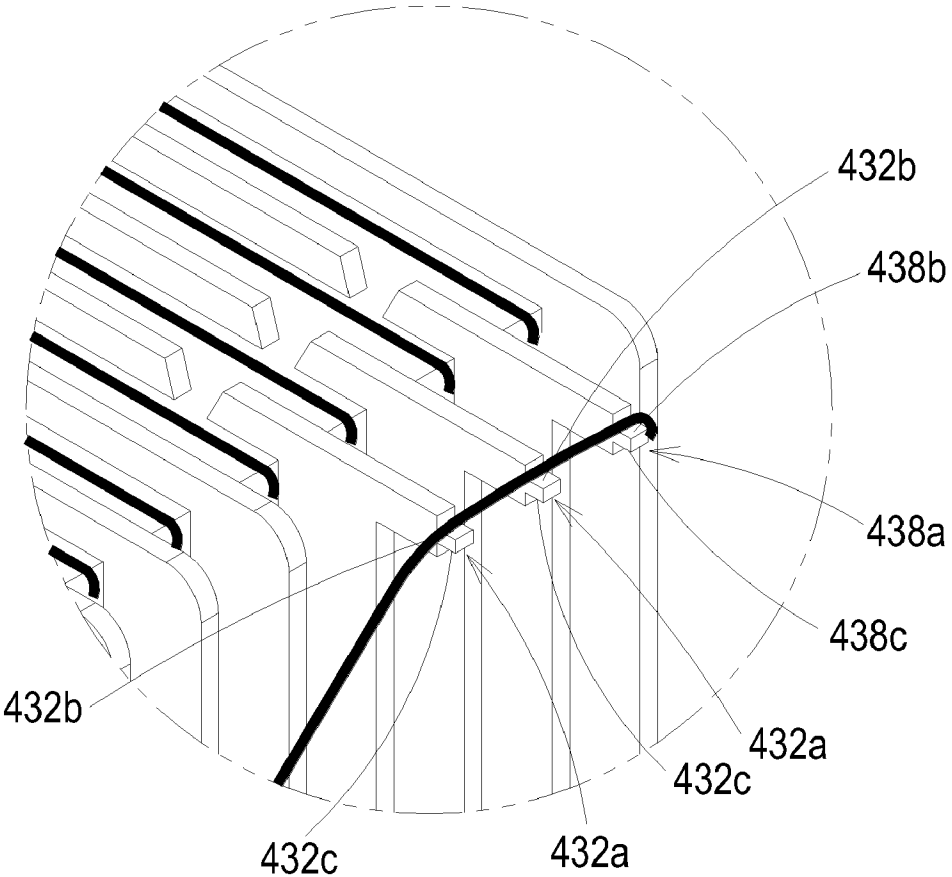
FIG. 4 is an enlarged fragmentary view illustrating the second bobbing piece of the transformer set as shown in FIG. 3.

FIG. 4 is an enlarged fragmentary view illustrating the second bobbin piece of the transformer set as shown in FIG. 3. In this embodiment, the first auxiliary ribs 438*a* and 432*a* are protruding blocks. In addition, respectively notches 438*b* and 432*b* are formed in the upper peripheries of the protruding blocks. When the first secondary winding coil 47 is returned back, the returning portion of the first secondary winding coil 47 is received within the notches 438*b* and 432*b* so that the returning portion of the first secondary winding coil 47 is initially fixed. In addition, for combining the second bobbin piece 43 with the first bobbin piece 42, the second bobbin piece 43 is moved toward and partially accommodated within the first sheathing part 422 of the first bobbin piece 42 so that the lower peripheries 438*c* and 432*c* of the first auxiliary ribs 438*a* and 432*a* are sustained against the third partition plate 422*b* of the first sheathing part 422. As such, after the second bobbin piece 43 is accommodated within the first sheathing part 422 of the first bobbin piece 42, the returning portion of the first secondary winding coil 47 is received within the notches 438*b* and 432*b*. Since the returning portion of the first secondary winding coil 47 is not in direct contact with the third partition plate 422*b* of the first sheathing part 422, the safety distance between the returning portion of the first secondary winding coil 47 and the first secondary winding coil 47 wound on the first winding section 434 will be sufficient. In this circumstance, the problem of causing the high-voltage spark is avoided.

Please refer to FIG. 3 again. The third bobbin piece 44 and the first bobbin piece 42 are arranged in bilateral symmetry. The configurations of the base 441, the second sheathing part 442, the receptacle 442*a*, the fourth partition plate 442*b* and the third channel 443 of the third bobbin piece 44 are similar to those of the first bobbin piece 42, and are not redundantly described herein. Whereas, the fourth partition plate 442*b* is opposed to the third partition plate 422*b*. In addition, a first engaging element 441*a* is formed on the base 441, and a second engaging element 421*b* is formed on the base 421 of the first bobbin piece 42. Due to the engagement between the first engaging element 441*a* and the second engaging element 421*b*, the third bobbin piece 44 and the first bobbin piece 42 are combined together. In this embodiment, the first engaging element 441*a* is a concave structure, and the second engaging element 421*b* is a convex structure corresponding to the concave structure of the first engaging element 441*a*.

Similarly, the fourth bobbin piece 45 and the second bobbin piece 43 are arranged in bilateral symmetry. Whereas, the second auxiliary ribs 458*a* and 452*a* of the fourth bobbin piece 45 are opposed to the first auxiliary ribs 438*a* and 432*b* of the second bobbin piece 43. The fourth pin 457 of the fourth bobbin piece 45 is opposed to the second pin 437 of the second bobbin piece 43. For winding the second secondary winding coil 49 on the fourth bobbin piece 45, a first terminal of the second secondary winding coil 49 is firstly wound around and fixed on the third pin 456. Then, the second secondary winding coil 49 is successively wound on the second winding sections 454. Then, the second secondary winding coil 49 is returned back in the assistance of the second auxiliary ribs 458*a* and 452*a*. Then, a second terminal of the second secondary winding coil 49 is fixed on the fourth pin 457. By means of the first auxiliary ribs 438*a*, 432*b* and the second auxiliary ribs 458*a*, 452*a*, the safety distance between the returning portion of the first secondary winding coil 47 and the first secondary winding coil 47 wound on the first winding section 434 will be increased and the safety distance between the returning portion of the second secondary winding coil 49 and the second secondary winding coil 49 wound on the second winding section 454 will be increased. In this circumstance, the problems of causing high-voltage spark from the returning portions of the first secondary winding coil 47 and the second secondary winding coil 49 will be effectively avoided.

Figure 5:
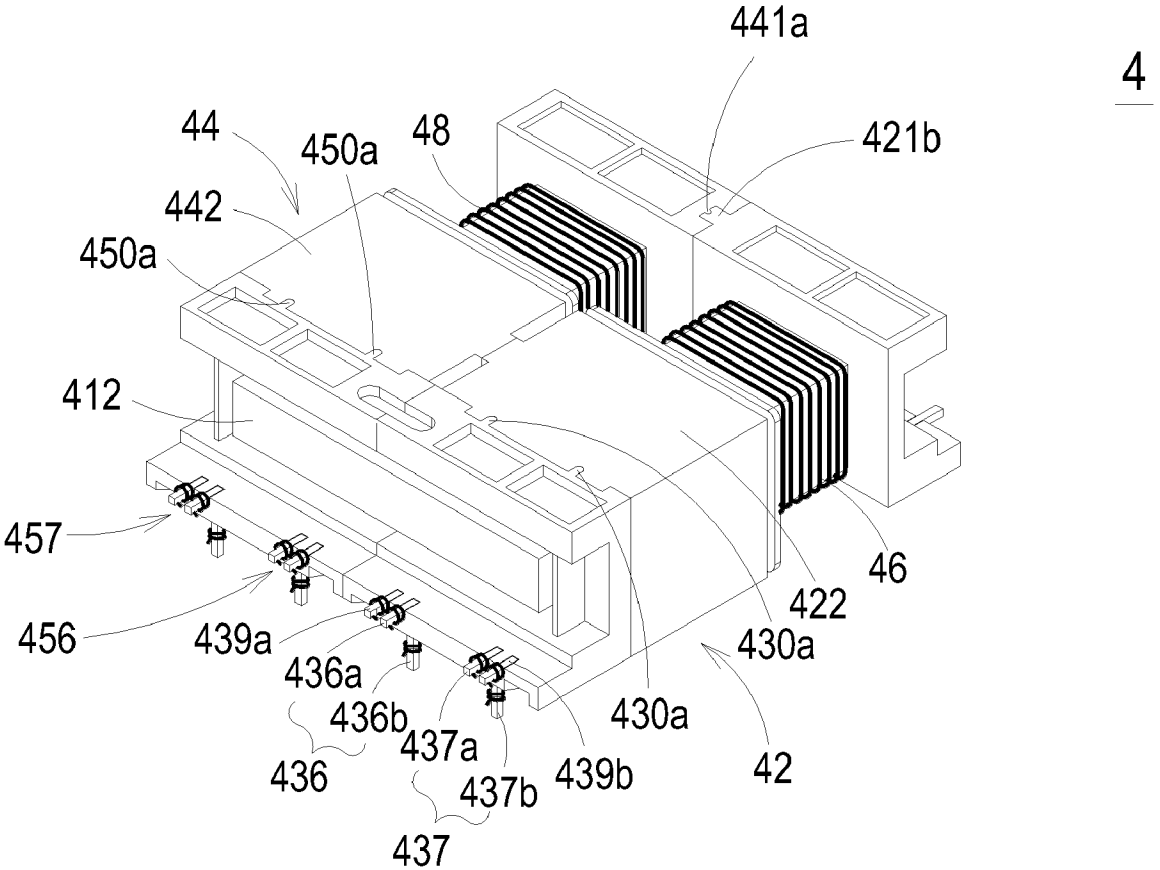
FIG. 5 is a schematic assembled view illustrating the transformer set of the present invention.

FIG. 5 is a schematic assembled view illustrating the transformer set of the present invention. Hereinafter, a process of assembling the transformer set 4 will be illustrated with reference to FIGS. 3, 4 and 5. Firstly, the second side plate 438 and the first secondary winding coil 47 wound on the second bobbin piece 43 are inserted into the receptacle 422*a* of the first sheathing part 422 of the first bobbin piece 42, and the second side plate 458 and the second secondary winding coil 49 wound on the fourth bobbin piece 45 are inserted into the receptacle 442*a* of the second sheathing part 442 of the third bobbin piece 44. As such, the first primary winding coil 46 and the first secondary winding coil 47 are isolated from each other by the first sheathing part 422, and the second primary winding coil 48 and the second secondary winding coil 49 are isolated from each other by the second sheathing part 442. Then, due to the engagement between the first engaging element 441*a* and the second engaging element 421*b*, the third bobbin piece 44 and the first bobbin piece 42 are combined together. In some embodiments, the second bobbin piece 43 and the fourth bobbin piece 45 have plural protrusions 430*a* and 450*a*, respectively; and the first bobbin piece 42 and the third bobbin piece 44 have indentions corresponding to the protrusions 430*a* and 450*a*. The protrusions 430*a* and 450*a* are engaged with the indentions so that the evenness of the transformer set is enhanced. Then, the first lateral leg 411*a* of the first magnetic part 411 is embedded within the first bobbin piece 42, the first lateral leg 412*a* of the second magnetic part 412 is embedded within the second bobbin piece 43, the second lateral leg 411*b* of the first magnetic part 411 is embedded within the third bobbin piece 44, and the second lateral leg 412*b* of the second magnetic part 412 is embedded within the fourth bobbin piece 45. The resulting structure of the transformer set 4 is shown in FIG. 5.

From the above description, the transformer set of the present invention has increased safety distance. By means of the first auxiliary ribs and the second auxiliary ribs, the safety distance between the returning portion of the first secondary winding coil and the first secondary winding coil wound on the second bobbin piece is increased, and the safety distance between the returning portion of the second secondary winding coil and the second secondary winding coil wound on the fourth bobbin piece is increased. As such, the problems of causing high-voltage spark from the returning portions of the first secondary winding coil and the second secondary winding coil will be effectively avoided. Moreover, after the first secondary winding coil and the second secondary winding coil are respectively accommodated within the sheathing parts of the first bobbin piece and the third bobbin piece, the possibility of abrading the winding coils is minimized. As a consequence, the yield of the transformer set is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer set, comprising:

a first bobbin piece for winding a first primary winding coil, wherein said first bobbin piece has a first sheathing part;

a second bobbin piece partially accommodated within said first sheathing part of said first bobbin piece, and comprising:

a first base having a first pin and a second pin; and plural first winding sections, wherein a first terminal of a first secondary winding coil is fixed on said first pin, then said first secondary winding coil is successively wound on said first winding sections and returned back, and then a second terminal of said first secondary winding coil is fixed on said second pin;

a third bobbin piece for winding a second primary winding coil, wherein said third bobbin piece has a second sheathing part, and said third bobbin piece and said first bobbin piece are arranged in bilateral symmetry;

a fourth bobbin piece partially accommodated within said second sheathing part of said third bobbin piece, wherein said fourth bobbin piece and said second bobbin piece are arranged in bilateral symmetry, and said fourth bobbin piece comprises:

a second base having a third pin and a fourth pin; and plural second winding sections, wherein a first terminal of a second secondary winding coil is fixed on said third pin, then said second secondary winding coil is successively wound on said second winding sections and returned back, and then a second terminal of said second secondary winding coil is fixed on said fourth pin, which is opposed to said second pin; and a magnetic core assembly partially embedded into said first bobbin piece, said second bobbin piece, said third bobbin piece and said fourth bobbin piece, wherein said first primary winding coil, said first secondary winding coil, said second primary winding coil and said second secondary winding coil interact with said magnetic core assembly to achieve voltage regulation.

2. The transformer set according to claim 1, wherein said first sheathing part has a third partition plate.

3. The transformer set according to claim 2, wherein said second sheathing part has a fourth partition plate.

4. The transformer set according to claim 3, wherein said second bobbin piece further comprises:

a first side plate, wherein said first base is extended from said first side plate;

a second side plate opposed to said first side plate;

plural first partition plates arranged between said first side plate and said second side plate; and a first slab arranged between said first side plate and said second side plate, wherein said plural first winding sections are defined by said first side plate, said second side plate, said first partition plates and said first slab.

5. The transformer set according to claim 4, wherein said second bobbin piece further comprises plural first auxiliary ribs, which are extended from said second side plate and said first partition plates for facilitating returning said first secondary winding coil, wherein when said second bobbin piece is combined with said first bobbin piece, said second bobbin piece is partially accommodated within said first sheathing part of said first bobbin piece, and said first auxiliary ribs are sustained against said third partition plate.

6. The transformer set according to claim 5, wherein said fourth bobbin piece further comprises plural second auxiliary ribs, which are extended from a fourth side plate and plural second partition plates of said fourth bobbin piece for facilitating returning said second secondary winding coil, wherein when said fourth bobbin piece is combined with said third bobbin piece, said fourth bobbin piece is partially accommodated within said second sheathing part of said third bobbin piece, and said second auxiliary ribs are sustained against said fourth partition plate.

7. The transformer set according to claim 4, wherein said first side plate, said second side plate and said first partition plates of said second bobbin piece are parallel with each other.

8. The transformer set according to claim 4, wherein said first partition plates have respective notches, and said first secondary winding coil is successively wound on said first winding sections through said notches.

9. The transformer set according to claim 4, wherein said first base of said second bobbin piece further comprises a third slab and a fourth slab, which are substantially perpendicular to said first side plate for increasing structural strength of said first base.

10. The transformer set according to claim 1, wherein said magnetic core assembly comprises a first magnetic part and a second magnetic part, and each of said first magnetic part and said second magnetic part includes a first lateral leg and a second lateral leg, wherein said first lateral leg of said first magnetic part is embedded within a first channel of said first bobbin piece, said second lateral leg of said first magnetic part is embedded within a third channel of said third bobbin piece, said first lateral leg of said second magnetic part is embedded within a second channel of said second bobbin piece, and said second lateral leg of said second magnetic part is embedded within a fourth channel of said fourth bobbin piece.

11. A transformer set, comprising:

a first bobbin piece for winding a first primary winding coil, wherein said first bobbin piece has a first sheathing part;

a second bobbin piece partially accommodated within said first sheathing part of said first bobbin piece, and comprising:

a first base having a first pin and a second pin;

plural first auxiliary ribs; and plural first winding sections, wherein a first terminal of a first secondary winding coil is fixed on said first pin, then said first secondary winding coil is successively wound on said first winding sections and returned back in the assistance of said first auxiliary ribs, and then a second terminal of said first secondary winding coil is fixed on said second pin;

a third bobbin piece for winding a second primary winding coil, wherein said third bobbin piece has a second sheathing part, and said third bobbin piece and said first bobbin piece are arranged in bilateral symmetry;

a fourth bobbin piece partially accommodated within said second sheathing part of said third bobbin piece, wherein said fourth bobbin piece and said second bobbin piece are arranged in bilateral symmetry, and said fourth bobbin piece comprises:

a second base having a third pin and a fourth pin;

plural second auxiliary ribs; and plural second winding sections, wherein a first terminal of a second secondary winding coil is fixed on said third pin, then said second secondary winding coil is successively wound on said second winding sections and returned back in the assistance of said second auxiliary ribs, and then a second terminal of said second secondary winding coil is fixed on said fourth pin; and a magnetic core assembly partially embedded into said first bobbin piece, said second bobbin piece, said third bobbin piece and said fourth bobbin piece, wherein said first primary winding coil, said first secondary winding coil, said second primary winding coil and said second secondary winding coil interact with said magnetic core assembly to achieve voltage regulation.

12. The transformer set according to claim 11, wherein said first sheathing part has a third partition plate.

13. The transformer set according to claim 12, wherein said second sheathing part has a fourth partition plate.

14. The transformer set according to claim 13, wherein said second bobbin piece further comprises:

a first side plate, wherein said first base is extended from said first side plate;

a second side plate opposed to said first side plate;

plural first partition plates arranged between said first side plate and said second side plate; and a first slab arranged between said first side plate and said second side plate, wherein said plural first winding sections are defined by said first side plate, said second side plate, said first partition plates and said first slab.

15. The transformer set according to claim 14, wherein said plural first auxiliary ribs are extended from said second side plate and said first partition plates, and when said second bobbin piece is combined with said first bobbin piece, said second bobbin piece is partially accommodated within said first sheathing part of said first bobbin piece, and said first auxiliary ribs are sustained against said third partition plate.

16. The transformer set according to claim 15, wherein said plural second auxiliary ribs are extended from a fourth side plate and plural second partition plates of said fourth bobbin piece, and when said fourth bobbin piece is combined with said third bobbin piece, said fourth bobbin piece is partially accommodated within said second sheathing part of said third bobbin piece, and said second auxiliary ribs are sustained against said fourth partition plate.

17. The transformer set according to claim 14, wherein said first side plate, said second side plate and said first partition plates of said second bobbin piece are parallel with each other.

18. The transformer set according to claim 14, wherein said first partition plates have respective notches, and said first secondary winding coil is successively wound on said first winding sections through said notches.

19. The transformer set according to claim 14, wherein said first base of said second bobbin piece further comprises a third slab and a fourth slab, which are substantially perpendicular to said first side plate for increasing structural strength of said first base.

20. The transformer set according to claim 11, wherein said magnetic core assembly comprises a first magnetic part and a second magnetic part, and each of said first magnetic part and said second magnetic part includes a first lateral leg and a second lateral leg, wherein said first lateral leg of said first magnetic part is embedded within a first channel of said first bobbin piece, said second lateral leg of said first magnetic part is embedded within a third channel of said third bobbin piece, said first lateral leg of said second magnetic part is embedded within a second channel of said second bobbin piece, and said second lateral leg of said second magnetic part is embedded within a fourth channel of said fourth bobbin piece.

* * * * *